US006720490B1

(12) United States Patent
Bruce

(10) Patent No.: US 6,720,490 B1
(45) Date of Patent: Apr. 13, 2004

(54) ADJUSTABLE MUSICIAN'S STAND

(76) Inventor: Harper M. Bruce, 211 Becca La., Stroudsburg, PA (US) 18360

( * ) Notice: Subject to any disclaimer, the term of this patent is extended or adjusted under 35 U.S.C. 154(b) by 0 days.

(21) Appl. No.: 10/145,051

(22) Filed: May 14, 2002

(51) Int. Cl.[7] ..... G10D 3/00

(52) U.S. Cl. ..... 84/327; 84/421; 84/329; 84/453

(58) Field of Search ..... 84/327–329, 421, 84/453

(56) References Cited

U.S. PATENT DOCUMENTS 4,067,527 A * 1/1978 Streit ..... 248/123.2
4,407,182 A * 10/1983 Biasini ..... 84/453
5,340,066 A * 8/1994 Ditch ..... 248/170
6,215,054 B1 * 4/2001 Woodhouse et al. ..... 84/421
6,215,056 B1 * 4/2001 Liao ..... 84/422.3

* cited by examiner

*Primary Examiner*—Shih-Yung Hsieh
(74) *Attorney, Agent, or Firm*—Charles A. Wilkin; Clinton H. Wilkin

(57) ABSTRACT

A stand for holding a microphone, music, or instrument having a horizontally adjustable base comprised of a plurality of adjustable telescoping members forming a U-shape support, such that the members of the base can be adjusted to avoid other equipment in a crowded stage area, thereby conserving space and enabling the stand to be conveniently situated closely together with such other equipment.

15 Claims, 7 Drawing Sheets

ADJUSTABLE MUSICIAN'S STAND

BACKGROUND OF THE INVENTION

1. Field of the Invention

The present invention relates to stands used by musicians, and more particularly to a microphone, music, or instrument music stand having a horizontally adjustable base particularly for use in a crowded stage or performing area.

2. Preliminary Discussion

Individual musicians such as guitarists or vocalists, as well as musical groups or bands, often perform in venues such as clubs, bars and the like where the stage or performing area is quite small. For example, many corner bars or clubs do not even have a separate stage area, and performers must clear an area of tables, chairs and other like items prior to setting up their equipment. In such situations, there is barely room for a band having several members to set up such equipment, which typically includes several microphone stands, amplification equipment, control processors, a keyboard, drum set and the like. In addition, after such equipment has been set up, there may be little room left over for the band members to move around during their performance, as they typically may desire. Even in clubs having larger performing areas, space is still at a premium, since most band members prefer to be able to move around the stage freely without having to worry about tripping over or running into their equipment.

Performers who both play an instrument, such as an electric guitar, while also providing vocals' encounter a slightly different space problem. Particularly where there is a limited area to move around, such performers will often remain in a more or less stationary position. However, it can be difficult to orient both a foot controller or processor equipment for an electric guitar and a microphone or music stand so that both are in sufficiently close proximity to the performer so that they can be reached without the performer having to continually change or shift positions. This difficulty is largely due to the shapes of such equipment. A typical microphone stand is comprised of a vertically adjustable telescoping pole connected to a round, weighted base situated directly beneath the pole, and is normally placed more or less directly in front of the performer so that the microphone is in close proximity to the performer's face and mouth whenever vocals are required. Electronic guitar foot controls or processing equipment are usually enclosed in a generally rectangular holder or box-like structure which also must be placed in close proximity to the performer so that such foot controls can be comfortably reached by the performer without requiring him or her to shift positions or move away from the microphone. However, placement of the round microphone stand base directly in front of the performer leaves little room for the foot controller. This conflict can adversely affect the quality of the performance, since the microphone and foot controls often may be required to be used simultaneously. The instant invention attempts to overcome this conflict by providing a microphone stand having a base that can be horizontally adjusted for placement around a foot controller or other objects, permitting both the microphone and foot controls to be directly in front of, and therefore within easy reach of, the performer.

3. Description of Related Art

Numerous examples of arrangements for stacking and folding microphone or music stands, or for adjusting the height of such stands, are known in the prior art. In addition, other types of music equipment such as electronic keyboards are usually provided with a support or frame structure. However, the inventor is not aware of a stand for holding a microphone, sheet music, or a small instrument such as a harmonica which stand can be horizontally adjusted to be situated around other equipment used by a musician, such as a foot controller, thereby making it easier to simultaneously use such equipment while also conserving space in a small or cramped stage area.

For example, U.S. Pat. No. 4,445,415 issued to G. J. Izquierdo on May 1, 1984, entitled "Portable Case and Stand for Pedal Controls Operationally Fixed Therein for use with a Keyboard Temporarily Mounted Thereon," discloses a box structure having several pedal controls for an electronic keyboard permanently mounted therein, which structure is also used to support an electric keyboard. Izquierdo is an example of a time and space-saving arrangement wherein the pedal controls can be situated underneath or in a music stand. However, instruments such as an electronic keyboard, which are elongated in shape, intrinsically have a space provided underneath such instrument for placement of the legs of the user, while stands for sheets of music, a microphone, or instruments such as a harmonica or drum machine typically do not provide such space.

U.S. Pat. No. 4,449,010 issued to F. L. Seebinger on May 15, 1984, entitled "Multi-Position Microphone Stand Support Assembly," discloses a support for a microphone wherein the vertical support column is pivotable, while the base remains stationary. Such stand allows for more than one microphone to be attached to the support, but does not disclose a horizontally adjustable base.

U.S. Pat. No. 4,718,624 issued to R. G. Greulich on Jan. 12, 1988, entitled "Folding Microphone Stand," discloses a tripod-type stand in which the support column can be pivoted on the base member, and having an aperture in the base member to accommodate the support column in a fully folding position. Pivoting the support column in relation to the base allows for easier transport or storage of the stand when it is not in use. However, in general folding tripod-type microphone stands are not preferred because they pass unwanted vibrations to the microphone.

U.S. Pat. No. 5,048,789 issued to D. H Eason et al. on Sep. 17, 1991, entitled "Microphone Stand," discloses a stand having a generally circular base and a U-shaped cutout portion so that several of such bases can be overlapped or stacked when stored. Eason et al. illustrates several other embodiments in which the base portion has a slightly different configuration while still retaining its stackable characteristics. However, none of such embodiments illustrates a base, which can be horizontally adjusted so as to fit around equipment such as a foot controller.

U.S. Pat. No. 5,090,648 issued to W. R. Wood, IV on Feb. 25, 1992, entitled "Stand Assembly," discloses a stand for holding doors, windows, and the like during painting. The base members of the Wood stand do not appear to be adjustable, however.

U.S. Pat. No. 5,106,048 issued to M. Lebar et al. on Apr. 21, 1992, entitled "Support Stands" discloses a music stand having tripod-type support legs wherein two of the legs are pivotable so that the legs can be folded in a storage position. Tripod-type support stands are well known in the prior art and may possibly be placed over or around a foot controller, but are not adjustable in the same manner as the present invention.

U.S. Pat. No. 5,149,901 issued to M. C. Boor et al. on Sep. 22, 1992, entitled "Guitar Support Apparatus," discloses a support for a guitar having a pair of parallel pipe-like legs with vertically extending supports spaced thereon.

U.S. Pat. No. 5,340,066 issued to K. J. Ditch on Aug. 23, 1994, entitled "Stand for Article," discloses another tripod-type adjustable microphone wherein one leg has incorporated a tilt assembly, which allows the angle of the microphone to be adjusted.

U.S. Pat. No. 5,611,508 issued to A. Palmero on Mar. 18, 1997, entitled "Horizontally Adjustable Microphone Support," discloses a microphone support having a telescoping horizontal cross member attached to the upper end of the vertical support column. The base member in Palmero, however, is a typical round base and is not adjustable.

U.S. Pat. No. 5,857,649 issued to D. H. Eason on Jan. 12, 1999, entitled "Stabilizing and Memory Musical Instrument Stand," discloses a music stand having a support frame shaped as a cross-frame which is pivotable about the intersection of the frame members.

U.S. Pat. No. 5,863,015 issued to H. Hsu on Jan. 26, 1999, entitled "Microphone Stand Elevating Device, discloses a device which makes it easier to upwardly or downwardly adjust the height of a microphone support column extending from the base of a microphone stand, although the configuration of the base cannot be adjusted.

U.S. Pat. No. 5,893,541 issued to D. Michaelson on Apr. 13, 1999, entitled "Microphone Stand Providing Quick Assembly and Disassembly," discloses an improved means for quickly assembling and disassembling a support column from a microphone stand base. The base, however, is made from a single generally oval solid structure and is not adjustable.

Despite the numerous microphone and music stands known in the prior art, each of which provides its own degree of utility, there is a need for a stand having a base portion which incorporates usable space in the center and which can be adjusted to conserve space on a cramped or crowded stage or performing area so as not to interfere with the placement of other music or performing equipment.

OBJECTS OF THE INVENTION

It is therefore a primary object of the invention to provide a stand for holding a microphone, sheet music, instrument or the like.

It is a further object of the invention to provide a stand providing floor space in the center portion of the base of the stand to accommodate music or other performing equipment.

It is a further object of the invention to provide a stand having a base portion comprised of a plurality of telescoping members which are independently adjustable.

It is a still further object of the invention to provide a stand wherein the telescoping members can be adjusted so as to surround or avoid other music equipment or control boxes on a stage floor such as speakers, foot controllers or effects processors.

It is a still further object of the invention to provide a stand which requires a minimum amount of space on a stage or performing area.

It is a still further object of the invention to provide a base which can be used to support a microphone stand, music stand, or instrument.

It is a still further object of the invention to provide a base for a microphone, instrument, or music stand which can be easily and quickly set up and stored in a compact configuration when not in use.

Still other objects and advantages of the invention will become clear upon review of the following detailed description in conjunction with the appended drawings.

SUMMARY OF THE INVENTION

A stand for use as a microphone stand, music stand, or instrument stand is provided having a telescopingly adjustable base arrangement which is designed to be used particularly in relatively cramped stage or performing areas where there is a need to conserve space, although such arrangement could be used in any performing area. Performers, particularly those musicians or bands performing in a small club or bar environment, often encounter a problem in that there is insufficient room to set up all of their electronic equipment in a reasonably effective manner. The present invention addresses this problem by providing a stand having a generally U-shaped frame or support providing floor space within the center of the "U" and wherein the length of the support members is adjustable so that the support members can be positioned compactly around other equipment such as processors or controllers, thereby more efficiently using the available floor space in setting up such equipment. The pitch or angle of the vertical microphone support column can be adjusted using screw-type foot members on the bottom of the stand. In addition, the foot members provide sufficient room between the floor and horizontal support members so that electric control wires powering the effects processor, instruments, or other equipment can be slipped under such members.

DESCRIPTION OF THE PREFERRED EMBODIMENTS

Figure 1:
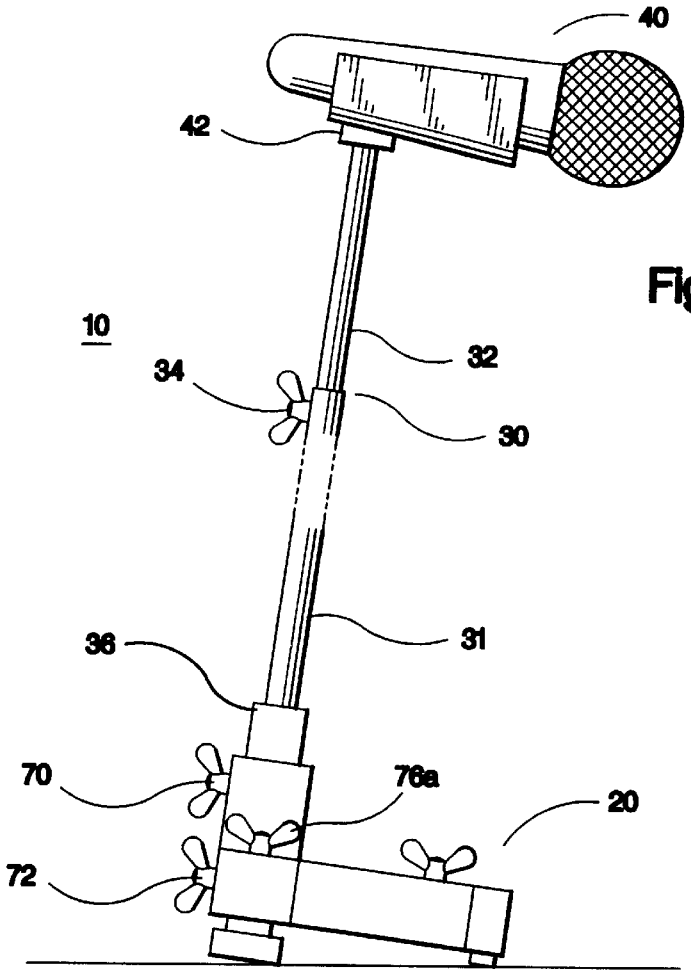
FIG. 1 is side elevation of the stand of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

It is frequently necessary or desirable to situate control pedals and other control equipment for loud speakers and other musical, performance and special effects equipment directly in front of a performer, which performer usually is also using a microphone or the like in his or her musical or other artistic performance. In a very large music hall or similar performing environment, there are usually sound men and other technical personnel to handle the operation of sound equipment, modify its effects from time to time as necessary, and generally monitor and adjust the rendition of any performance. A lone performer before smaller audiences, on the other hand, must modify the sound and musical effects him or herself and, since such performer cannot or should not, from an artistic viewpoint, be seen continually adjusting various knobs, dials, switches and the like, foot control pedals are usually provided to allow the performer adequate control of the technical aspects of sound control. Operation of such foot controls is not as visible and distracting to an audience as hand manipulation would be, and frequently an artists hands are otherwise occupied in any event. The most convenient and logical location for such foot control and other equipment is directly in front of the performer. However, where the performer is using a standup microphone, as is frequently necessary, if the artists hands are busy, the microphone base must also be in front of the performer unless the microphone can be supported on a pivoted or counterbalanced beam or pole arrangement from the side, which is sometimes done, or can be hung from the ceiling of the performing area, which is seldom possible in smaller or more general, as distinguished from, professional or specialized performing facilities. Consequently, there is considerable agonizing, adjusting and improvising by an artist before each performance trying to arrange the floor equipment such as foot controls and the like and the base of microphones and the like with respect to the performer. Not only is this improvising period time-consuming, but it also is tension-inducing for the performers and distracting during actual performance. The present inventor, having been presented as a performer with the problem, has ingeniously solved it by providing not only a microphone stand providing floor space in the center directly under the microphone, but one that is freely adjustable so that such stand can be readily adapted to performing equipment of various dimensions while maintaining the floor space taken up by the various equipment at a minimum. Thereby, a very significant problem for performers has been solved in a simple and expedient manner.

The same problem which occurs with microphone bases also frequently occurs with respect to music stands, instrument stands where an instrument must be partially supported or where a single musician must take up alternative instruments during a performance, and in such cases the present invention providing an open base stand with adjustable lateral dimensions may be used also with great effectiveness. The stand of the invention or base for a stand of the invention is particularly useful also where the stage or performing area is cramped and lacking in space as very many less professional performing areas are.

Reference will now be made in detail to a presently preferred embodiment of the invention as illustrated in the accompanying drawings. Whenever possible, the same reference numbers will be used throughout the drawings to refer to the same or like parts.

Figure 2:
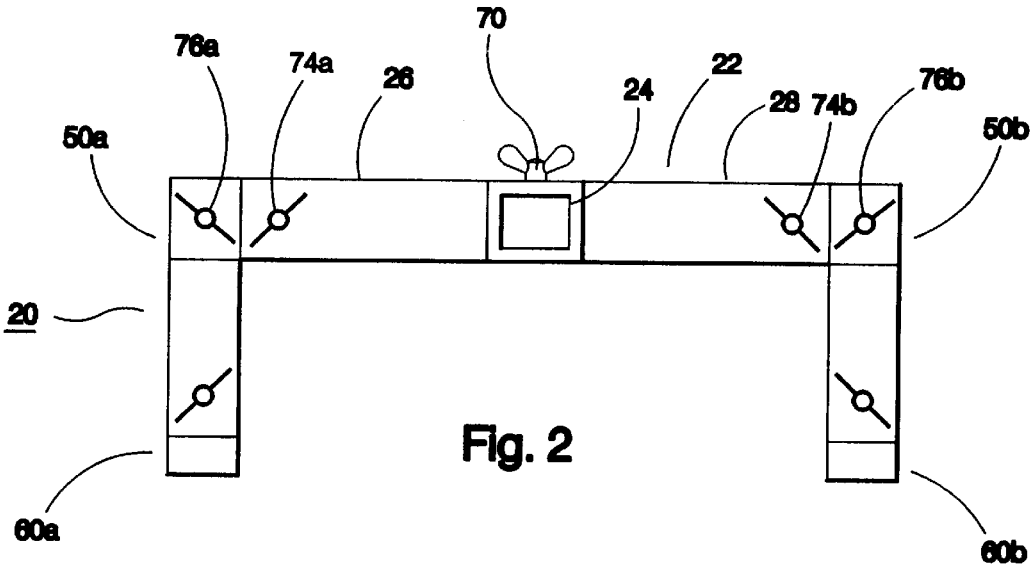
FIG. 2 is a top or plan view of the base portion of the stand of the present invention.
Figure 3:
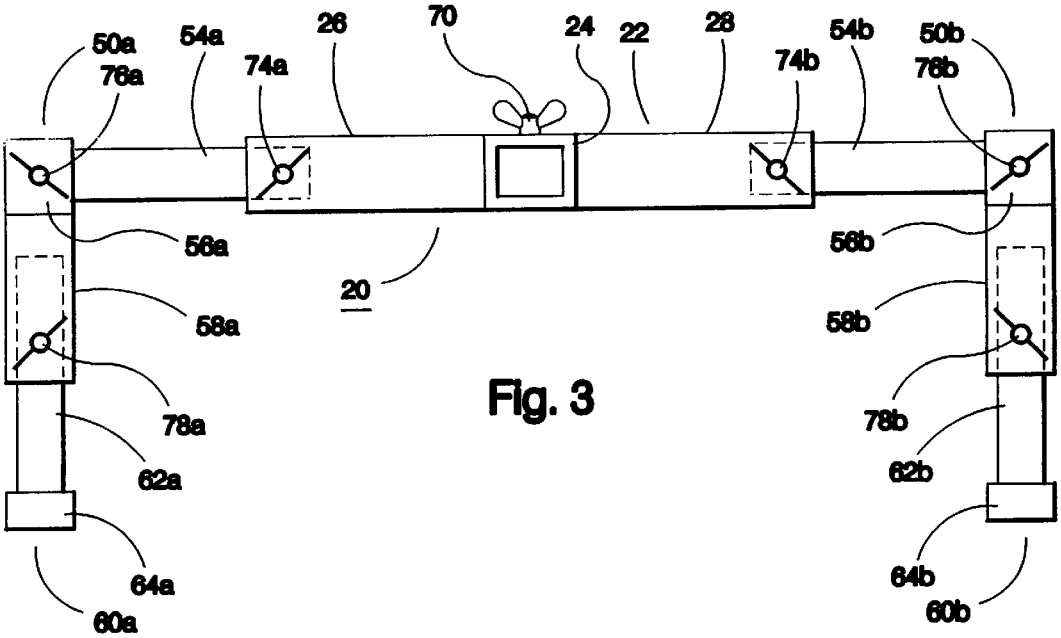
FIG. 3 is a top or plan view of the base portion of the stand similar to FIG. 2 with the individual telescoping base members extended to or toward their maximum.
Figure 4:
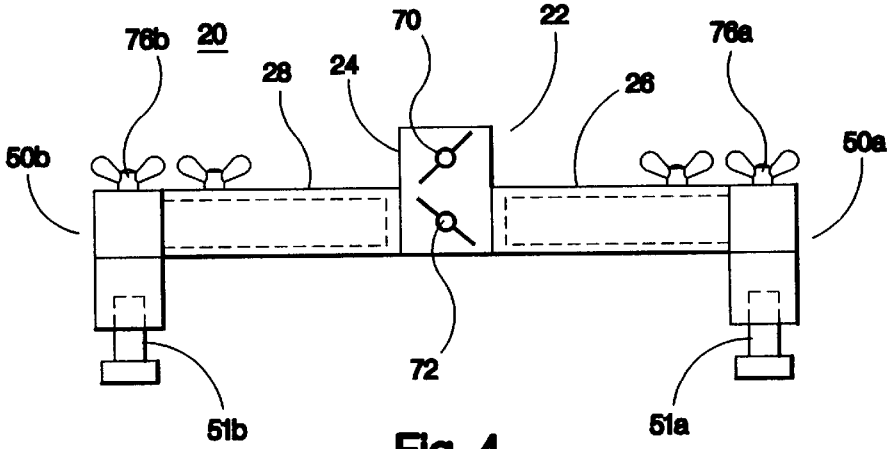
FIG. 4 is a rear view a slightly alternative version of the base, as it would originally be viewed from the audience side.
Figure 5:
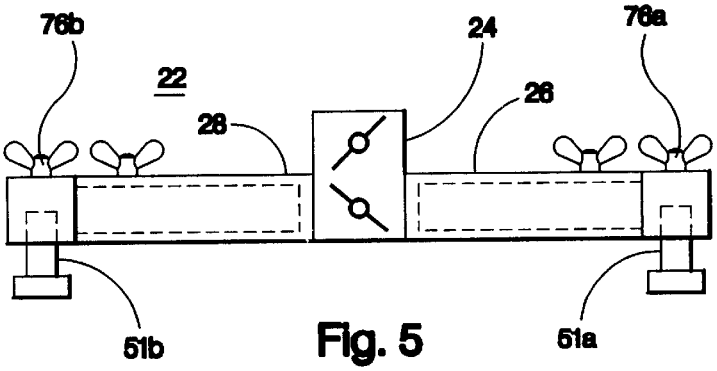
FIG. 5 is a rear view of the base as shown in FIGS. 1–3, as it would normally be viewed from the audience side.
Figure 6:
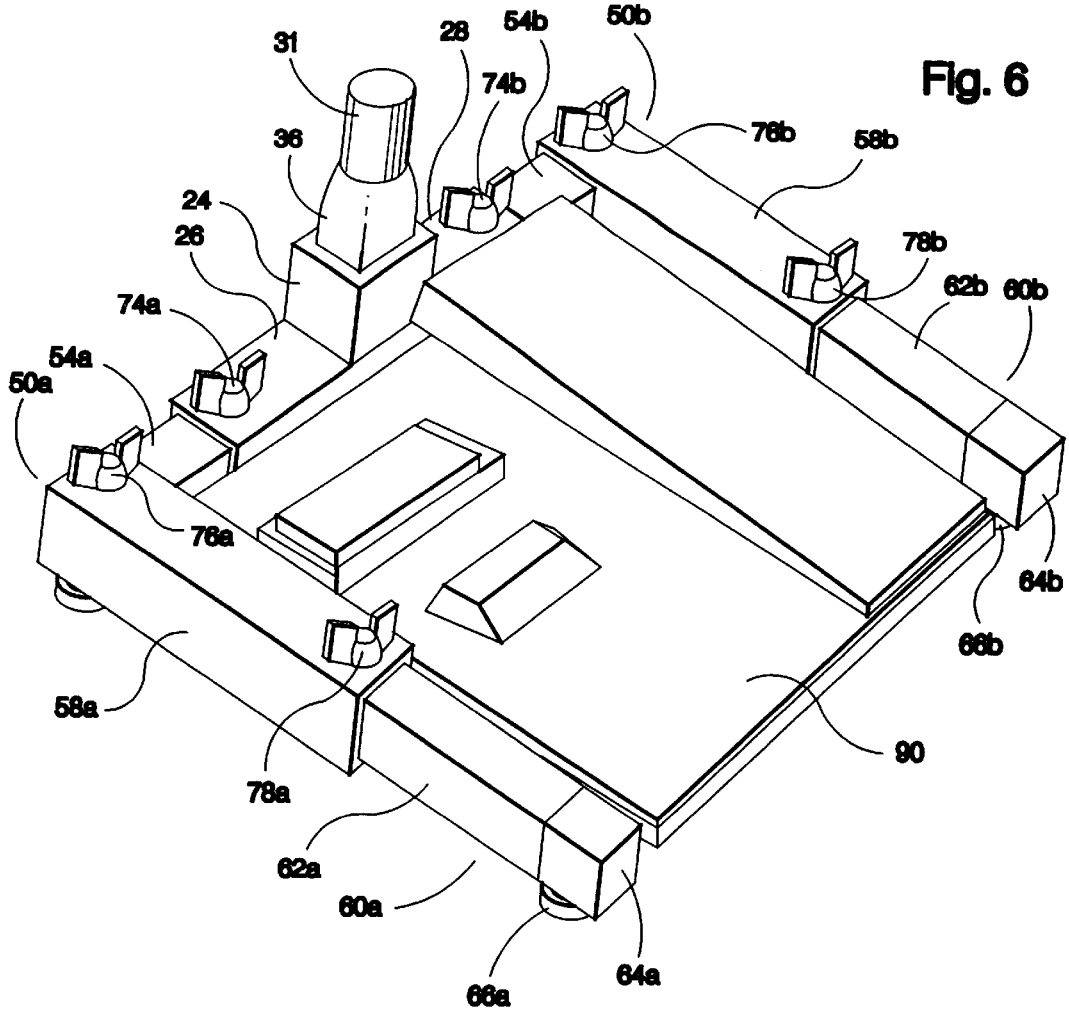
FIG. 6 is an isometric view of the base surrounding a typical foot control device.
Figure 7:
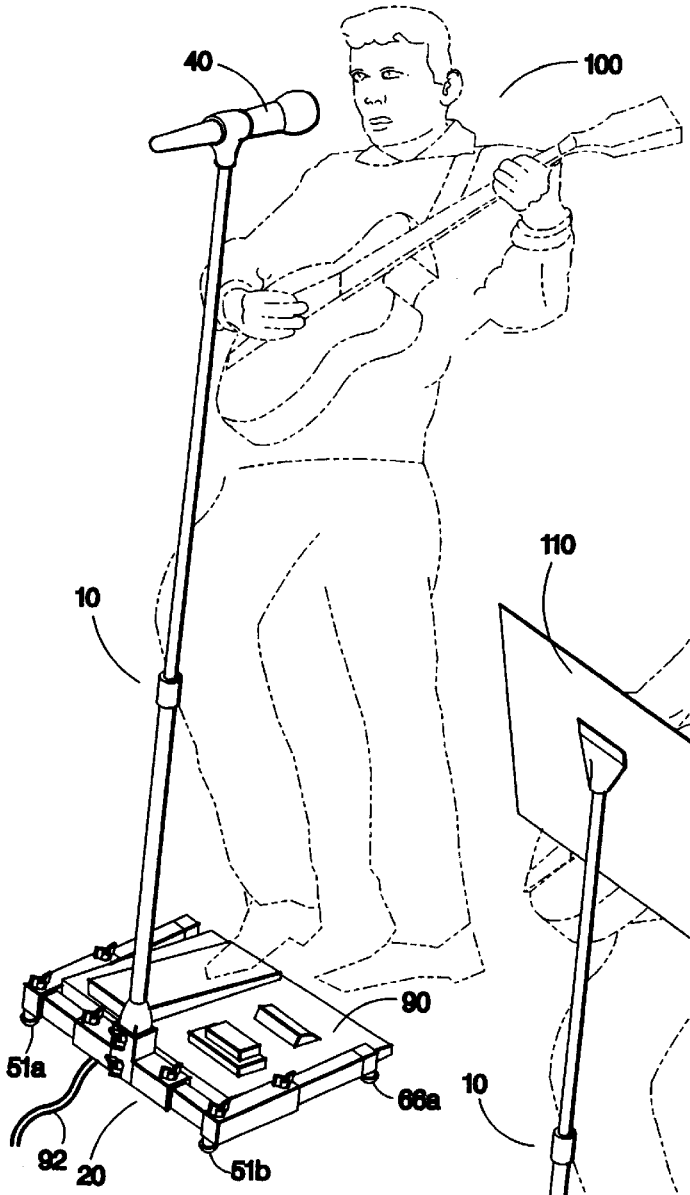
FIG. 7 is an isometric view of an artist using a microphone mounted on the stand of the invention shown in FIG. 5.
Figure 8:
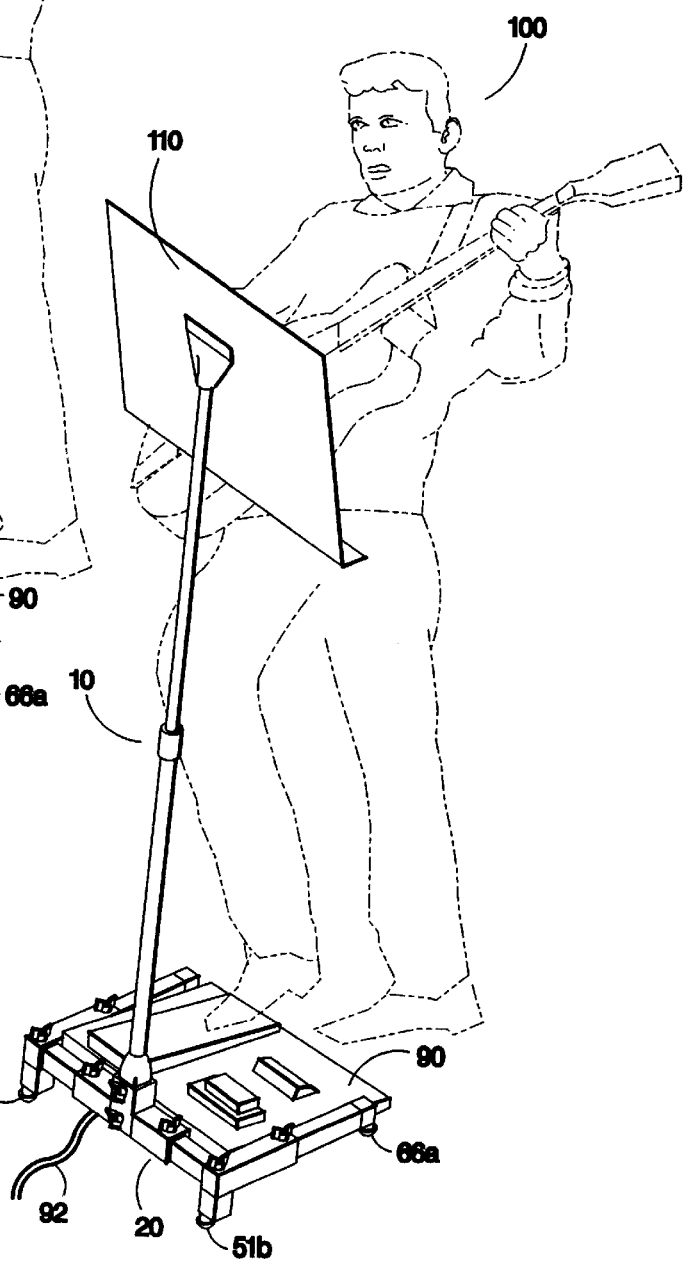
FIG. 8 is an isometric view of an artist using the stand of the invention shown in FIG. 4 as a music stand.

FIGS. 1–9 illustrate a first preferred embodiment of the invention, with FIGS. 4 and 8 illustrating a slightly alternative embodiment, while FIGS. 10–15 illustrate another possible alternative embodiment. FIG. 1 is a side elevation view of the first preferred embodiment of the adjustable musician's stand 10 of the present invention. While such example of the invention illustrates the stand 10 supporting a microphone 40, it is envisioned that the stand 10 can also be used as a music stand, instrument stand, or the like. In addition, the scale of FIG. 1 may appear distorted because the microphone 40 appears large compared to the microphone support rod or member 30. However, support rod 30 should be understood to be considerably longer, it having been foreshortened in the figure by not showing a central section indicated by dotted lines, and in actuality, the usual microphone support rod will be three or four times as lengthy and usually telescopically adjustable as described below. A typical microphone supported on a stand in accordance with the invention in use by a performing artist is shown in FIG. 7.

Referring still to FIG. 1, stand 10 is generally comprised of a base 20 supporting or being coupled to a vertically extending post or support member 30, with microphone 40 secured on the upper end of support member 30 by bracket or clip 42. Microphone cable clips, not shown, may also be situated on support member 30 to secure a microphone cable, also not shown. A swiveling boom may also be provided as is known in the prior art. Preferably, the height of support member 30 is telescopingly adjustable, and is comprised of an outer telescoping member or portion 31 which is secured at its lower end in base 20, and an inner telescoping member or portion 32. The relative position of such members can be fixed at a desired height or position by a threaded locking mechanism 34 such as a threaded wing nut fastening of a type known in the prior art located on the upper end of outer member 31, whereby relative movement between the telescoping members during use is prevented and the length of the vertical support member 30 is temporarily fixed or maintained as desired. Alternatively, inner telescoping member 32 can lock in position by rotating inner member 32 in relation to outer telescoping member 31, or various other clamping means known to those skilled in the art can be used.

FIGS. 2–5 illustrate various views and orientations of the supporting base 20, while FIG. 6 illustrates the base 20 surrounding a typical foot controller device designated by reference number 90. As will be shown below, the supporting base of the inventor's stand 10 is constructed with a U-shaped frame so that the center portion is relatively open, thereby leaving room for other equipment to also be placed directly in front of the performer. In addition, the legs of supporting base or base extensions 20 are also horizontally adjustable, so that the base of the stand can be more easily and efficiently arranged around other equipment on a crowded stage. In addition, each of the base support members can be detached from the stand 10 or otherwise adjusted for easier storing or carrying.

Still referring to FIGS. 2–5, base 20 is comprised generally of hub or central portion 22, first and second telescoping or extensible corner members 50*a* and 50*b,* and first and second telescoping or extensible leg members 60*a* and 60*b.* In combination, such parts form a generally U-shaped frame or supporting base having an open center and enable base 20 to be situated in a finite number of different generally horizontal configurations so that the stand 10 does not interfere with the placement of other electronic equipment on a stage or performing area directly in front of the performer. Each of such parts is preferably made from the same material, which can be any suitable material such as anodized aluminum, hard plastic, steel or the like.

Upwardly facing stand socket 24 is situated generally at the midpoint of central portion 22. As is most clearly shown in FIGS. 1 and 4, outer portion 31 of telescoping microphone support 30 is placed in and coupled to socket 24 by threaded securing members 70 and 72. While stand socket 24 is shown in the FIGS. as having a rectangular shape to accommodate the rectangular base of coupling member 36 on the bottom of the outer portion 31 of microphone support rod 30, such socket 24 can be in any shape depending primarily upon the shape of particular coupling member. In addition, coupling member 36 may be either a permanent part of the support rod 30 or may be slip fitted over the bottom of the support rod 30. Socket 24 is preferably coated with a rubber material that acts as a barrier to prevent floor vibrations from passing through the stand and support rod to the microphone, thereby greatly reducing the risk of feedback vibrations interfering with the quality of the sound.

First and second outer sleeves 26 and 28 of central portion 22 extend horizontally from opposite sides of sleeve or stand socket 24, while corner members 50*a* and 50*b* are telescopingly-coupled in sleeves 26 and 28. As best shown in FIG. 3, corner member 50*a* is comprised of first inner sleeve 54*a,* corner piece 56*a,* and, aligned perpendicular to first inner sleeve 54*a,* outer sleeve 58*a*. Similarly, corner member 50*b* includes second inner sleeve 54*b,* corner piece 56*b,* and, aligned perpendicular to second inner sleeve 54*b,* outer sleeve 58*b*. See FIG. 3, which shows the inner sleeves extended and therefore visible. First and second inner sleeves 54*a* and 54*b* are sized to telescopingly couple with first and second outer sleeves 26 and 28 on central portion 22, respectively. Threaded screw members 74*a* and 74*b* are adjustably secured in threaded apertures generally near the outer ends of sleeves 26 and 28, respectively, for jam holding inner sleeve sections 54*a* and 54*b* in position with respect to outer sleeves 26 and 28. Although parts 54*a,* 56*a* and 58*a,* and 54*b,* 56*b* and 58*b,* respectively, are labeled separately, preferably they are integrally made as a single cast or otherwise fabricated piece. In addition, in each case, the threaded screw members are shown as having a wing nut on the exterior of an underneath threaded fastening to jam against a sliding section below to maintain the sections in position with respect to each other. However, the wing section could also be a hexagonal or other head fastener or bolt adapted to impinge against the adjacent member and jamb fit the two together. Other suitable fasteners could also be used. Hand screw members 76*a* and 76*b* may also be threadably secured in apertures on the top face of corners members 50*a* and 50*b,* respectively, while screw members 78*a* and 78*b* are threadably secured in apertures near the outer ends of sleeves 58*a* and 58*b,* respectively, to maintain the inner sleeves 54*a* and 54*b* in the end pieces 50*a* and 50*b*. Ground engaging or foot members 51*a* and 51*b,* shown in FIG. 4, are located on the bottom side of corner pieces 56*a* and 56*b* to actually support the front of the base 20 on an underlying support surface. Such foot members may be fixed on the bottoms of corner members 50*a* and 50*b* or may preferably be adjustable with respect to the corner members. Suitable adjustment may be obtained by thread attachment into the corner members or alternatively by the use of threaded type jam fittings, not shown, in the end of the corner pieces. First and second leg members 60*a* and 60*b* are comprised of inner telescoping members 62*a* and 62*b* having connected on their outer ends members 64*a* and 64*b*. Telescoping members 62*a* and 62*b* are sized to extensibly or telescopingly couple with outer sleeves 58*a* and 58*b,* respectively. In addition, as shown in FIG. 6, adjustable screw-type foot members 66*a* and 66*b* are preferably threadably secured to the bottom side of end members 64*a* and 64*b* so that the pitch or angle of the vertical microphone support column can be adjusted. In most cases, support member 30 is preferably angled towards a musician playing an instrument so that the stand does not interfere with the playing of such instrument held in front of the musician. A further angle or pitch to the support column can be provided by increasing the height or depth of corner members 56*a* and 56*b,* as shown in FIG. 4, or by adding as shown an additional piece onto the bottom side of corner members 56*a* and 56*b,* as illustrated in FIG. 8. Such arrangement also provides room for heavier cables to pass underneath the support members of base 20.

In FIG. 6, base 20, see FIGS. 1 and 2, is shown placed on a generally horizontal surface such as a stage or performing area and adjusted so that the telescoping members are surrounding a foot controller 90 of a type typically used in controlling an electric instrument such as an electric guitar. Base 20 is configured so that it surrounds the controller 90 on three sides, with central portion 22, see FIG. 2, extending along the entire front of the controller 90, first corner member 50*a* being situated at the left front corner of the controller, first leg member 60*a* extending along one side of the controller, second corner member 50*b* being positioned at the right front corner of the controller, and second leg member 60*b* extending along the opposite side. After the base 20 is situated as desired, screw members 74*a–b,* 76*a–b* and 78*a–b* are tightened so that the telescoping members are secured in such position. In addition, as indicated above, stand 10 can be easily angled slightly forward or to one side by adjusting the position of foot members 51*a–b* and 66*a–b,* respectively. The foot members could also be used to compensate for an unevenness or slant in the stage floor or performing area, which might occur particularly in an older performing facility. In addition, as shown in FIGS. 7 and 8, foot members 51*a* and 51*b* and 66*a* and 66*b* raise the base 20 off the stage floor a sufficient distance so that electric wires 92 operating the effects controller 90, music equipment, or other wires can be easily slipped between floor and the adjustable base members. As indicated above, the angle of the support member can also effect the ability of a musician to play his or her instrument, and can be adjusted accordingly using the foot members.

By using the telescoping base 20 of the present invention, vertical member 30, partially shown in FIG. 6, can be situated so that it is in close proximity to the foot controller and both are in close proximity to the musician while performing with the foot controller 90 centrally located. The musician therefore no longer has to strain or lean to one side, or otherwise compensate for the disparate positions of the microphone and foot controller. In addition, such arrangement more efficiently allocates or utilizes the available space, which is important particularly in a small or cramped performing area. Such an arrangement would not be possible using prior art base systems, which typically comprise a generally circular weighted base member, because it would be impossible to centrally position such base member so that it does not interfere with the placement of the controller.

FIG. 7 is an isometric view of the stand 10 of the invention in use on a stage by a performer 100 playing an electric guitar. Vertical member 30, see FIG. 1, holds or supports a microphone 40, while base 20 surrounds a controller 90, which the performer is using to modulate or otherwise control the details of his performance. It is evident how the stand enables the performer to have both the microphone and the control stand conveniently before him. In addition, the stand is tilted forward so that there is room for the performer to play the guitar while also having the microphone close to his mouth.

FIG. 8 is an isometric view of the stand 10 of the invention used as the base of a music stand 110, rather than a microphone, of a musician playing an electric guitar. It is evident how the stand of the invention facilitates positioning of the music directly in front of the musician with the controls for the instrument also readily available to the musician's feet.

Figure 9:
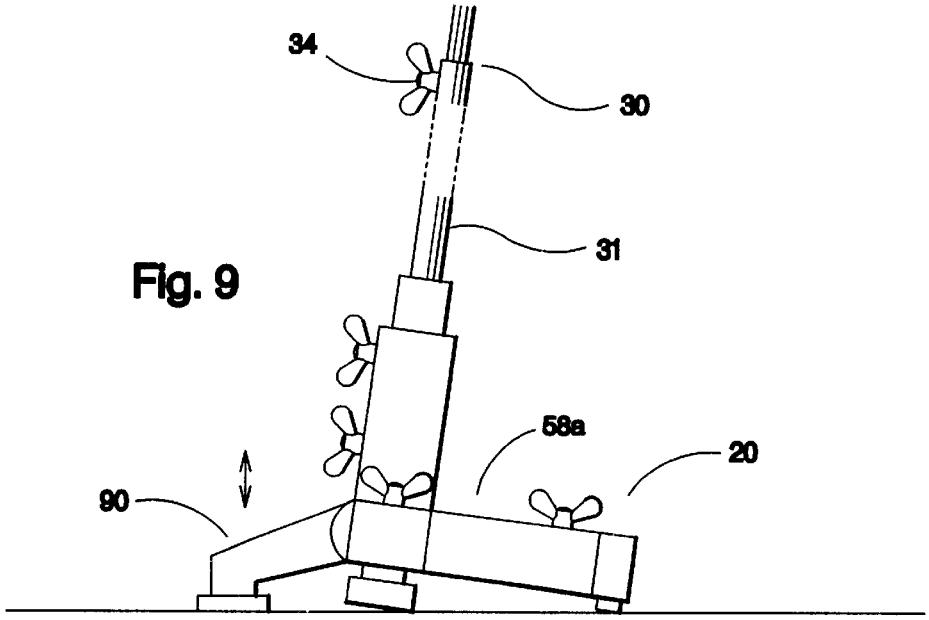
FIG. 9 is a side elevation of another slightly alternative embodiment of the invention.

Other variations to the base 20 may also be provided. For example, it is envisioned that a rubber or other vibration damping layer on base 20 may be provided in addition to rubber coated stand socket 24 to reduce any vibrations from the equipment from interfering with the microphone. FIG. 9 is a side elevation view of another possible alternative embodiment of the invention wherein an extra stabilizing member 98 is provided extending generally opposite the direction of members 58*a* and 58*b* from the front side of stand socket 24. Stabilizing member 98 is provided to eliminate the possibility that the base 20 might tip in such direction, although by angling the base generally forward using the foot members, such possibility has already been substantially lessened. There is always a possibility of the stand being accidentally impacted by movements of the performer or by other accidental forward impact, however, and the stabilizer member 98 guards against such possibility. Member 98 is preferably vertically pivotable so that after stand 20 has been situated as desired, member 98 is pivoted downwardly until it contacts the stage surface, similar to a pivoting door stop. Suitable pivoting may be attained in several different manners, including an adjustable hinge arrangement or the like, not shown. Stand socket 24 has been slightly modified to accommodate placement of member 98. Alternatively, rather than having a single centrally located support member 98, a pair of such support members could be located on sleeves 26 and 28 or first and second corner members 50*a* and 50*b*.

FIGS. 10–15 illustrate another alternative embodiment of the stand 110 having a slightly different base arrangement but wherein the base is also telescopingly adjustable so that it can be accommodated to or placed or situated around other equipment in a crowded stage area. In general, in such alternative embodiment of the base, instead of the base being formed from heavy tubular or cast sections of whatever composition, such base is formed from lighter plastic or aluminum sections, which sections may be square or rectangular or tubular in cross section. The heavy tubular or cast construction tends to be fairly steady upon a performing stage or platform because of its substantialness, but heavier and more difficult to transport. The alternative base is formed from lighter, thinner tubular sections that can be easily folded together and transported, but may be less steady and more easily toppled by accidental impact without being unduly unstable. The same principle of having the supporting arm extending upwardly at an angle from the base and having legs or base sections extended to the side and then rearwardly at the ends in the same direction as the inclination of the microphone or other support and having a space in the center into which foot control equipment may be centered is adhered to and the base sections are adjustable in two directions, i.e. forward and back and to the side by preferably a telescoping construction. Since the tubular sections are fairly light gauge, the device, while still fairly steady, is lighter and easy to transport. The central section may also be easily disassembled, if desired, for transportation.

Figure 12:
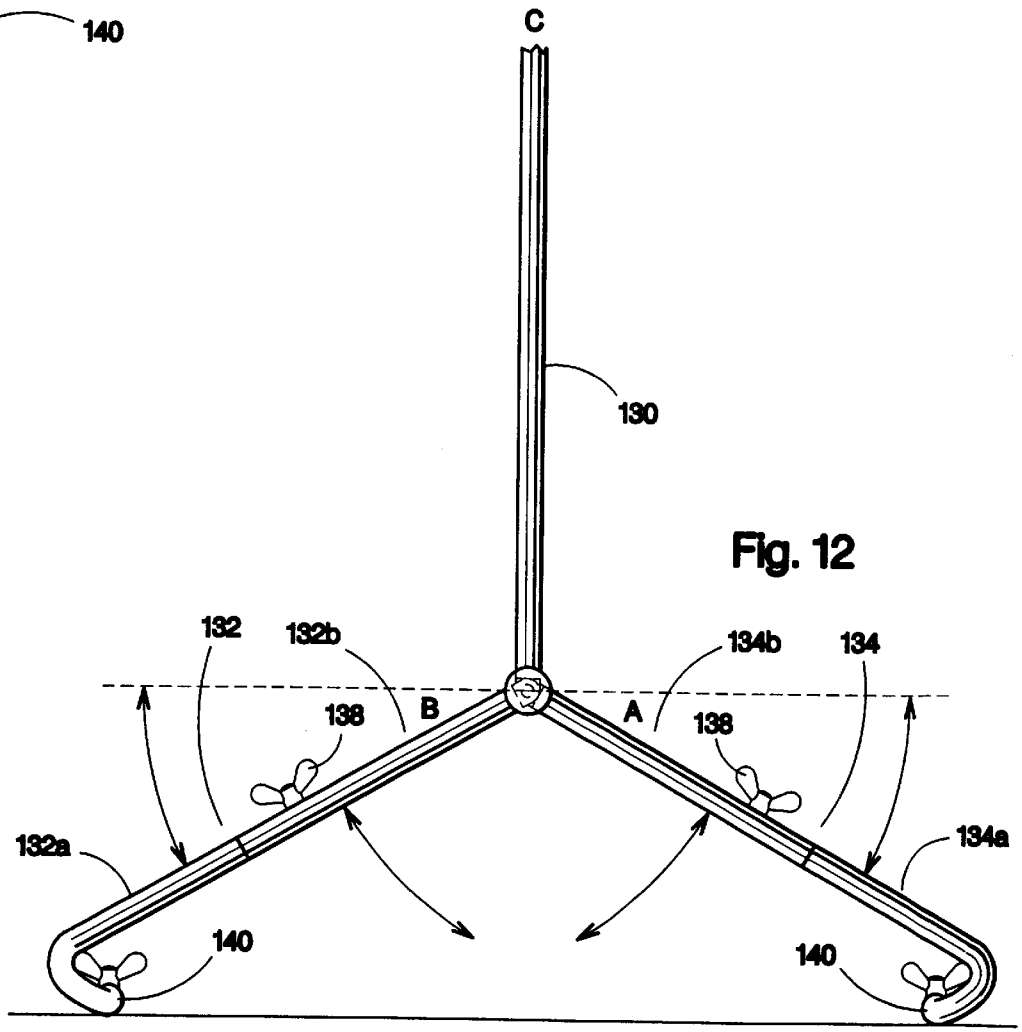
FIG. 12 is a front view of the stand shown in FIGS. 10 and 11 with the leg members slightly pivoted away from a support surface.
Figure 10:
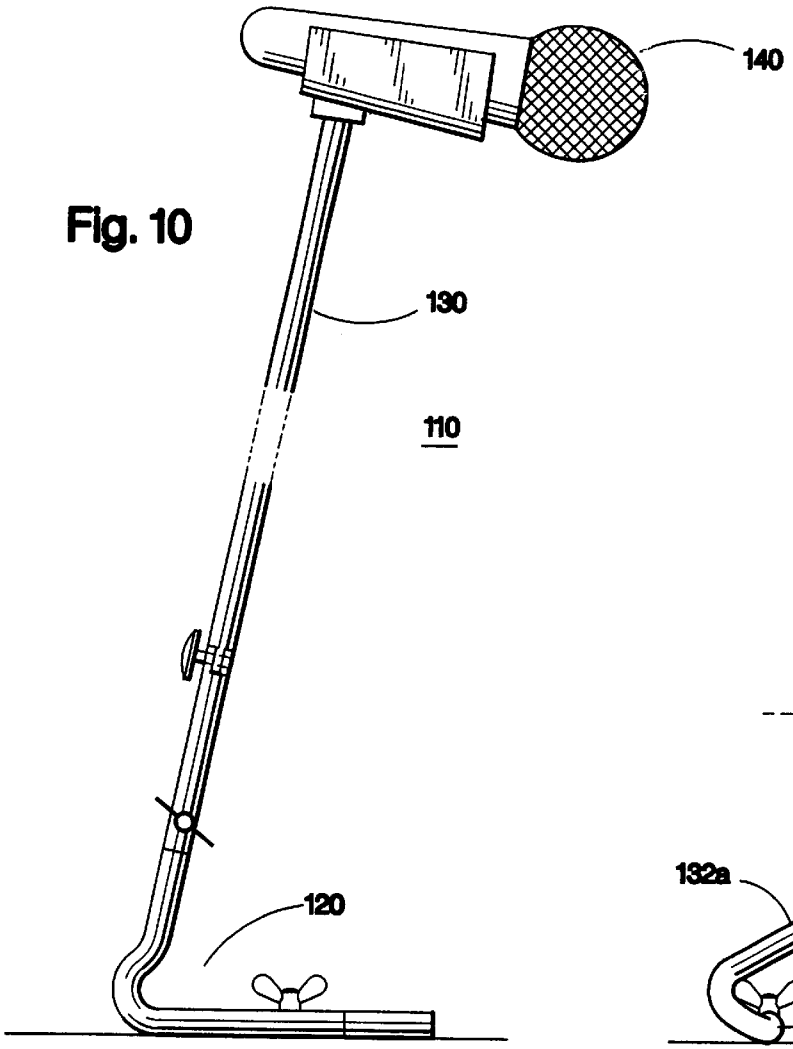
FIG. 10 is a side elevation view of another alternative embodiment of the invention.
Figure 13:
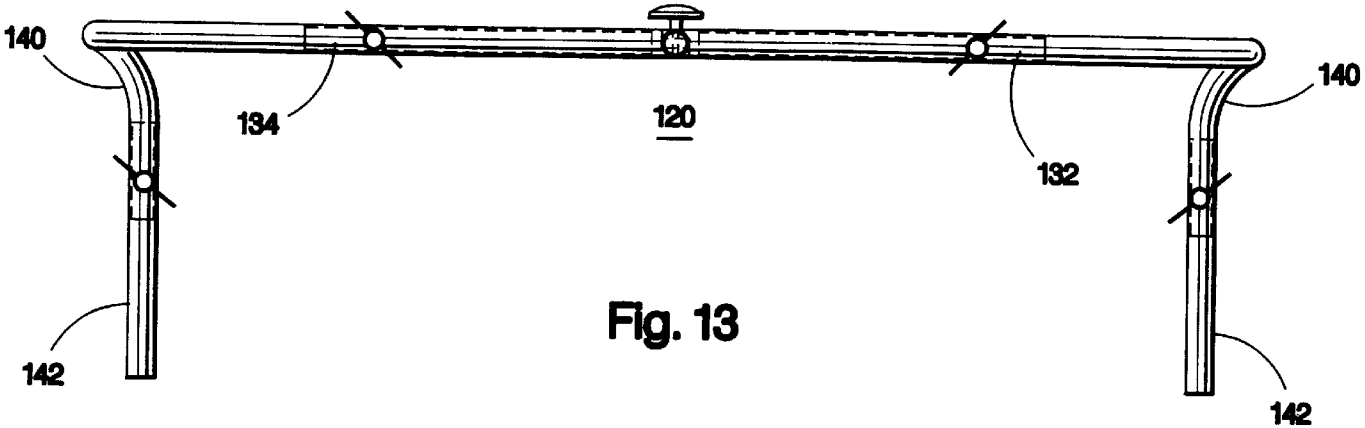
FIG. 13 is a top view of the base of the stand shown in FIG. 10.
Figure 11:
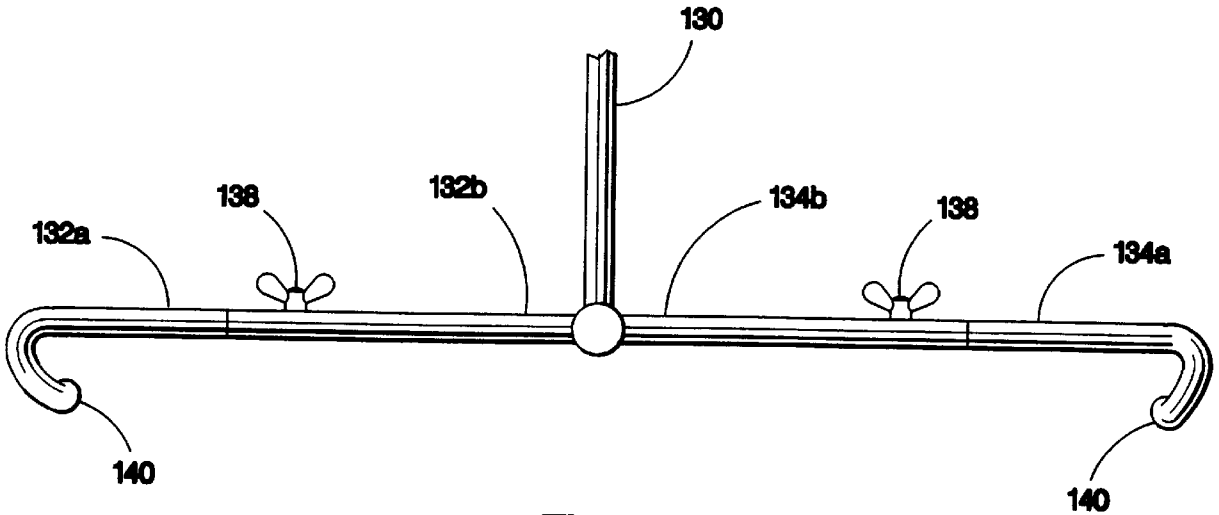
FIG. 11 is a rear view of the stand shown in FIG. 10, as it would normally be viewed from the audience side.

FIG. 10 is a side view of stand 110 which is comprised of base 120, adjustable support member 130, and any suitable clip or holder for microphone 140. As shown in FIGS. 11 and 12, base 120 is comprised of two outwardly extending leg members 132 and 134. Preferably, each leg member 132 and 134 is comprised of inner and outer telescoping sections 132*a–b* and 134*a–b*, which are secured or held together by threaded jam members 138. In addition, the leg members preferably have downwardly curved outer ends which form feet 140. Leg members 132 and 134 are generally pivotable from a position shown in FIG. 11, where the legs are situated so that they are generally horizontal to the floor or stage surface while support member 130 is perpendicular to such leg members, to a position such as shown in FIG. 12, where the legs have been pivoted so that they are angled in relation to the floor, as indicated by the arrows. As is visible in FIG. 13, which is a top view of the base 120, feet 140 are generally angled downwardly and then extend at right angles from leg members 132 and 134 so that a U-shaped arrangement is formed. Extending outwardly from the ends of feet 140 are telescoping side or foot members 142, which are adjustable in the same manner as in the previously described embodiments.

Figure 14:
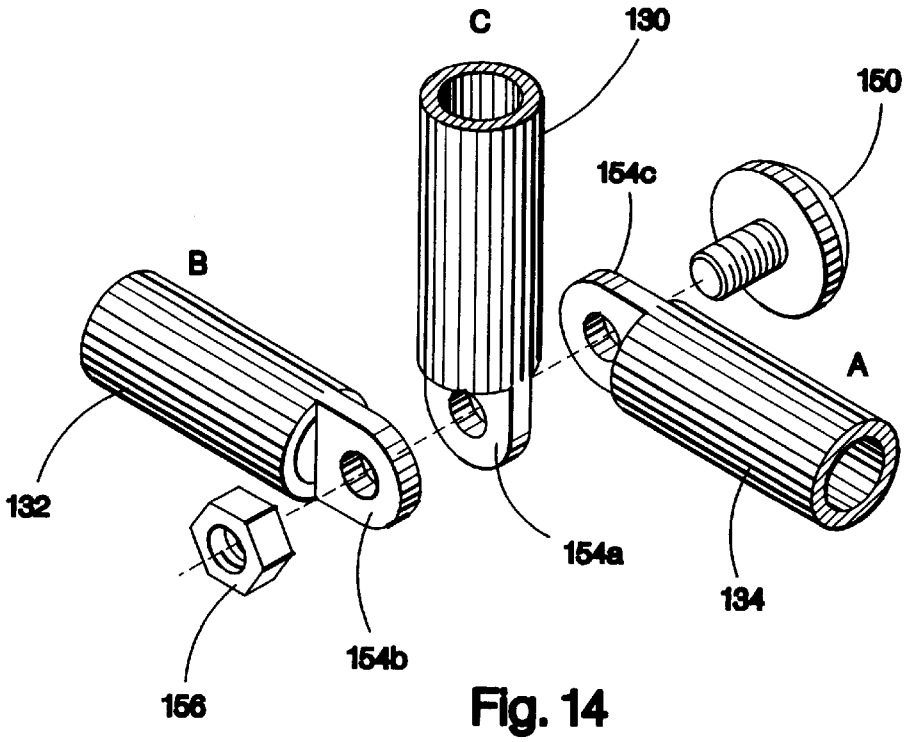
FIG. 14 is a close-up isometric view of the arrangement for attachment of the leg members to the support member in FIG. 10 shown disconnected or disassembled for clarity.
Figure 15:
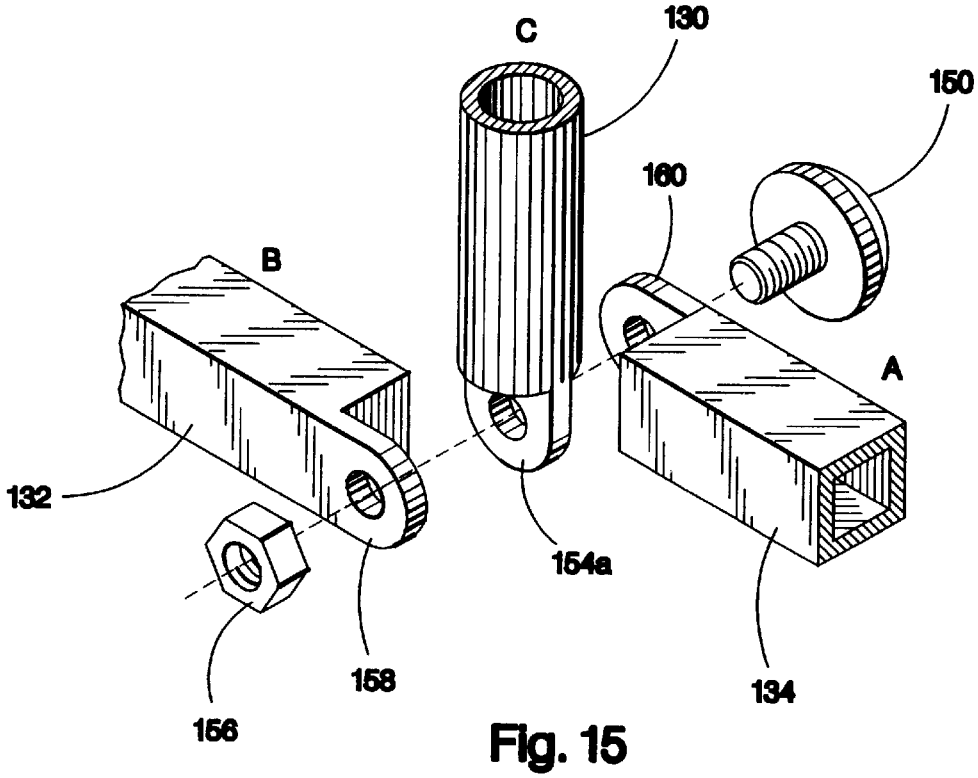
FIG. 15 illustrates a slightly alternative arrangement for attachment of the leg members to the microphone support member also shown disconnected or disassembled for clarity.

FIGS. 14 and 15 show two slightly different arrangements for securing leg members 132 and 134 to microphone support member 130. In FIG. 14, apertures 154*a*, 154*b*, and 154*c* are positioned on or near the ends of support member 130 and leg members 132 and 134, respectively. Bolt 150 may be passed through each of such apertures and secured by nut 156 so that leg members are pivotable about the same point. In FIG. 15, leg members 132 and 134 have upper and lower generally horizontal offset portions 158 and 160 to which apertured end 154*a* of support member 130 is pivotably secured. Either arrangement is an acceptable means for enabling the angle of leg members 132 and 134 to be easily adjusted. It will be understood that the intersecting sections containing fastening orifices will be oriented so that when connected together by suitable fastenings the base sections will extend to the side while the microphone or apparatus support section will extend upwardly with a slant in the same direction as the end of the legs of the base. As shown in FIG. 10, for example, support member 130 is preferably angled slightly forwardly as in the previous embodiments. In addition, FIG. 11 shows that sufficient room is provided between the floor or stage area and leg members 132 and 134 for wiring or cables to be strung, making setup of electronic equipment even easier. Each of the embodiments shown accomplishes the same purpose of providing sufficient space directly in front of a performer for placement of equipment in addition to a microphone stand, thereby improving the ability of a musician to give an effective and enjoyable performance.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A U-shaped musician's stand base for supporting a vertically extending support member positioned in front of a musician comprising:

(a) a central base portion having a means for supporting said vertically extending support member and having first and second central outer sleeve members extending laterally outwardly on opposite sides of said support means, (b) corner members having first and second central inner sleeve members telescopingly connected to the central base portion in said central outer sleeve members and having first and second outer side sleeve members situated substantially perpendicular to said central sleeves, (c) a pair of inner side sleeve leg members telescopingly connected to said outer leg members, (d) said central base portion, corner members, and inner side sleeve members defining an open area in which a foot operated controller may be placed surrounded on three sides by said stand base, enabling both said stand base and controller to both be positioned substantially directly in front of and in close proximity to a musician.

2. The musician's stand base in accordance with claim 1 wherein said means for supporting the vertically extending support member includes a coupling for securing a vertical support to said support base substantially in the central portion of the U, and additionally comprising (e) means for preventing relative movement of said telescopingly connected central and side inner sleeves in said central and side outer sleeves.

3. The musician's stand base in accordance with claim 2 additionally comprising (f) one or more adjustable foot members attached to the bottom side of the stand base.

4. The musician's stand base in accordance with claim 2 in which said corner members comprise a downwardly angle section extending between said inner sleeve members and said outer leg members.

5. The musician's stand base in accordance with claim 4 wherein the relative angle of said first and second outer sleeves is changeable at the point of connection with said vertically extending support member.

6. The musician's stand base in accordance with claim 4 additionally comprising a further stabilizing member connected extending outwardly from said central base portion in a direction substantially opposite of said leg members.

7. The musician's stand base in accordance with claim 1 wherein the vertical support is comprised of an outer telescoping member secured on one end to the support base in said support means and an inner telescoping member having a means for attaching a microphone on its upper end.

8. A base for a substantially vertically extended support member comprising:

(a) a principal base member with a coupling for attachment of a vertical support adapted to support an aid to a musical artist at a convenient level to the head of the artist, (b) at least two first extensions opposite to each other from the principal base member adapted along with the principal base member to be supported upon a stage surface, (c) the extensions from the principal base member being outwardly adjustable from the vertical support coupling, (d) at least two second extensions positioned outwardly from the principal base member and extensible at a substantial angle from the first extensions near the outer ends of said first extensions, and (e) the positioning of the extensions being such as to form an open area in front of a musician using the support member, and (f) each of the first and second extensions being itself expansible longitudinally so that the open area in front of a musician is expanded.

9. A base in accordance with claim 8 wherein the extensions are expansible by a telescoping action.

10. A base in accordance with claim 9 additionally including (g) surface contacting feet at the ends of at least some of the extensions.

11. A base in accordance with claim 10 additionally including (h) jam screw members for temporary fixing the extensions in any given extended position.

12. A floor equipment compatible microphone stand incorporating an adjustable sized rectangular free space immediately in the rear for the receipt of floor equipment said free space being defined in the front by laterally extendable base members and to the side by front to back extendable base members adapted to partially surround floor equipment comprising:

(a) a base comprised of two laterally extensible substantially horizontally disposable base members with means for supporting a central substantially vertically disposed support member, (b) two extensible end members extensible at right angles from the laterally extensible horizontally disposable base members, (c) the central vertically disposed support member being vertically extensible and having means for holding a microphone.

13. A floor equipment compatible microphone stand in accordance with claim 12 wherein the two laterally extensible substantially horizontally disposable base members are telescopingly extensible.

14. A floor equipment compatible microphone stand in accordance with claim 13 wherein the two extensible end members are telescopingly extensible.

15. A floor equipment compatible microphone stand in accordance with claim 14 additionally comprising vertically adjustable foot means along at least two points along the laterally extensible horizontally disposable base members which adjustable foot means when partially extended tip the microphone stand rearwardly.

* * * * *